US010246242B2

(12) United States Patent
Reeves

(10) Patent No.: US 10,246,242 B2
(45) Date of Patent: Apr. 2, 2019

(54) DUAL COMPONENT PACKAGING KIT

(71) Applicant: Douglas E. Reeves, Edmond, OK (US)

(72) Inventor: Douglas E. Reeves, Edmond, OK (US)

( * ) Notice: Subject to any disclaimer, the term of this patent is extended or adjusted under 35 U.S.C. 154(b) by 4 days.

(21) Appl. No.: 15/866,169

(22) Filed: Jan. 9, 2018

(65) Prior Publication Data

US 2018/0127188 A1 May 10, 2018

Related U.S. Application Data

(63) Continuation-in-part of application No. 14/734,410, filed on Jun. 9, 2015, now abandoned, which is a continuation-in-part of application No. 13/792,527, filed on Mar. 11, 2013, now abandoned.

(51) Int. Cl.

| | |
|---|---|
| ***B65D 21/02*** | (2006.01) |
| ***B65D 81/32*** | (2006.01) |
| ***B65D 77/04*** | (2006.01) |
| ***B65D 25/40*** | (2006.01) |
| ***B65D 25/14*** | (2006.01) |
| ***B65D 25/28*** | (2006.01) |
| ***B65D 25/16*** | (2006.01) |

(52) U.S. Cl.

CPC ..... *B65D 81/3222* (2013.01); *B65D 21/0233* (2013.01); *B65D 25/14* (2013.01); *B65D 25/16* (2013.01); *B65D 25/2894* (2013.01); *B65D 25/40* (2013.01); *B65D 77/048* (2013.01); *B65D 77/0486* (2013.01); *B65D 81/3216* (2013.01)

(58) Field of Classification Search

CPC ..... B44D 3/122; B44D 3/123; B44D 3/125; B44D 3/121; A45F 3/16; B65D 81/3216; B65D 81/3222; B65D 81/3288; B65D 25/14; B65D 25/16; B65D 25/2894; B65D 25/40

USPC ..... 220/23.4, 23.88, 5.24, 4.27, 23.83; 222/129, 131, 468

See application file for complete search history.

(56) References Cited

U.S. PATENT DOCUMENTS

| | | | |
|---|---|---|---|
| 679,144 | A | 7/1901 | Hardesty |
| 819,191 | A | 5/1906 | Weeks |
| 909,715 | A | 1/1909 | Troegeler |

(Continued)

FOREIGN PATENT DOCUMENTS

| | | |
|---|---|---|
| DE | 2149569 | 3/1978 |

OTHER PUBLICATIONS

PCT International Search Report, Application No. PCT/US2014/23493, Applicant: Douglas E. Reeves, dated Jul. 14, 2014, pp. 1-12.

*Primary Examiner* — Charles Cheyney

(74) *Attorney, Agent, or Firm* — Hall Estill Attorneys at Law

(57) ABSTRACT

A dual component packaging kit that includes at least a shape holding outer container having an internal volume and an external surface. Preferably, the shape holding outer container is configured to accommodate a pair of shape holding inner containers. Preferentially, each of the pair of shape holding inner containers contain a separate and distinct viscous material and the pair of shape holding inner containers remain detached from the shape holding outer containers at all times. With the pair of shape holding inner containers removed from the shape holding outer container, the separate and distinct viscous materials may be poured into the shape holding outer container and mixed together for use.

14 Claims, 7 Drawing Sheets

(56) References Cited

U.S. PATENT DOCUMENTS 1,527,349 A * 2/1925 Curley ..... A47J 41/0088 206/545
1,848,331 A 3/1932 Esslinger
2,047,164 A 7/1936 Coleman
2,663,450 A 3/1953 Andrews
2,661,678 A * 12/1953 Freeman ..... A47G 19/14 220/23.83
2,841,313 A 7/1958 Beall, Jr.
3,187,757 A * 6/1965 Jones, Jr. ..... A45C 11/008 132/314
3,559,849 A 2/1971 Ancel
3,978,232 A * 8/1976 Dodsworth ..... B65D 1/26 426/115
4,165,812 A 8/1979 Jennison
4,194,619 A * 3/1980 Schley ..... A45F 3/16 206/217
4,267,928 A 5/1981 Curry
4,472,440 A 9/1984 Bank
4,805,793 A 2/1989 Brandt et al.
5,115,916 A * 5/1992 Beasley ..... A45C 7/0045 206/504
5,356,026 A 10/1994 Andress et al.
5,398,897 A 3/1995 Sverdlik
5,706,980 A 1/1998 Dickerson
5,725,122 A 3/1998 Murphy et al.
5,934,501 A 8/1999 Wright et al.
6,029,858 A 2/2000 Srokose et al.
6,050,455 A 4/2000 Soehnlen et al.
6,159,232 A 12/2000 Nowakowski
6,478,808 B2 11/2002 Nowakowski
6,989,022 B2 1/2006 Nowakowski
7,543,705 B2 6/2009 Yourist
7,988,005 B2 * 8/2011 Wagner ..... B44D 3/122 220/23.83
8,381,932 B2 2/2013 Wagner
8,534,483 B1 * 9/2013 Rodriguez ..... B65F 1/085 220/23.88
2006/0131337 A1 6/2006 Mertins
2009/0261096 A1 10/2009 Wagner
2010/0314274 A1 12/2010 Saunders et al.
2014/0158713 A1 6/2014 King et al.
2015/0202765 A1 * 7/2015 Paternostro ..... B25G 1/00 294/141

* cited by examiner

SECTION C-C

SECTION D-D

SECTION E-E

DUAL COMPONENT PACKAGING KIT

CROSS REFERENCE TO RELATED APPLICATION

This application is a continuation-in-part of copending U.S. patent application Ser. No. 14/734,410 filed Jun. 9, 2015, entitled "Dual Component Packaging Kit" which is a continuation-in-part of U.S. patent application Ser. No. 13/792,527 filed Mar. 11, 2013.

FIELD OF THE INVENTION

The claimed invention relates to the field of product packaging schema, and more particularly to a packaging schema for dual component products that need to be isolated one from the other during shipping and handling.

SUMMARY OF THE INVENTION

In accordance with various exemplary embodiments, a dual component packaging kit that includes at least a shape holding outer container having an internal volume and an external surface. Preferably, the shape holding outer container is configured to accommodate a pair of shape holding inner containers. Preferentially, each of the pair of shape holding inner containers contain a separate and distinct viscous material and the pair of shape holding inner containers remain detached from the shape holding outer containers at all times. With the pair of shape holding inner containers removes from the shape holding outer container, the separate and distinct viscous materials may be poured into the shape holding outer container and mixed together for use.

In an alternate exemplary embodiment, the shape holding inner container includes at least a first interior volume formed by a first hermetically sealed bottom, and a first open top, the first interior volume containing a first viscous material, and a second interior volume attached to the first interior volume. Preferably, the second interior volume is formed by a second hermetically sealed bottom, and a second open top, the second interior volume containing a second viscous material, wherein the first and second viscous material are separate and distinct viscous materials. Additionally featured by the alternate exemplary embodiment is a separation wall disposed between and attached to the first and second interior volumes, the separation wall isolates the first viscous material from the second viscous material.

These and various other features and advantages that characterize the claimed invention will be apparent upon reading the following detailed description and upon review of the associated drawings.

DETAILED DESCRIPTION OF AN EXEMPLARY EMBODIMENT OF THE DRAWINGS

Reference will now be made in detail to one or more examples of various embodiments of the present invention depicted in the figures. Each example is provided by way of explanation of the various embodiments of the present invention, and not meant as a limitation of the invention. For example, features illustrated or described as part of one embodiment may be used with another embodiment to yield still a different embodiment. Other modifications and variations to the described embodiments are also contemplated within the scope and spirit of the claimed invention.

Figure 1:
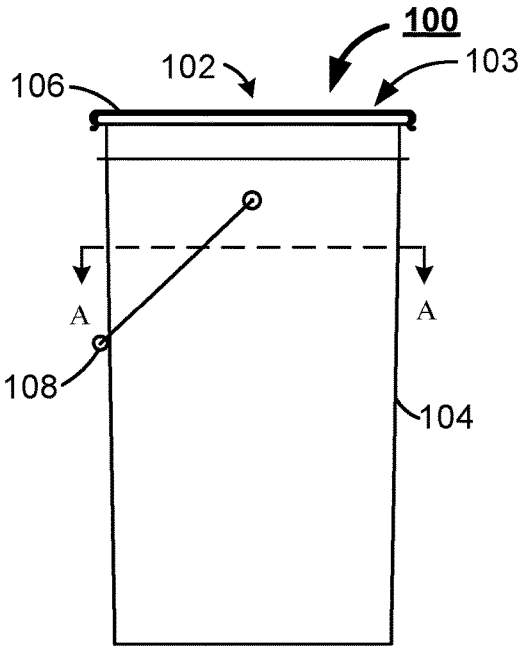
FIG. 1 displays a view in elevation of an exemplary embodiment of a shape holding outer container.
Figure 2:
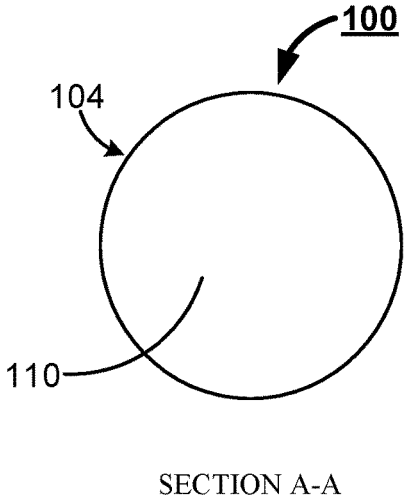
FIG. 2 provides a cross section view of the shape holding outer container of FIG. 1.

Turning to the drawings, FIG. 1 displays an exemplary shape holding outer container 100 which includes at least an internal volume 102 and an external surface 104, in which the internal volume 102 of the exemplary shape holding outer container 100 is not less than two liters. A volume of the shape holding outer container 100 of less than two liters leads to an imbalance in the manufacturing process and diminishes the commercial utility of the product. In a preferred embodiment, the shape holding outer container 100 includes a lid 106, a handle 108, and as shown by FIG. 2, a hermetically sealed bottom 110.

Figure 3:
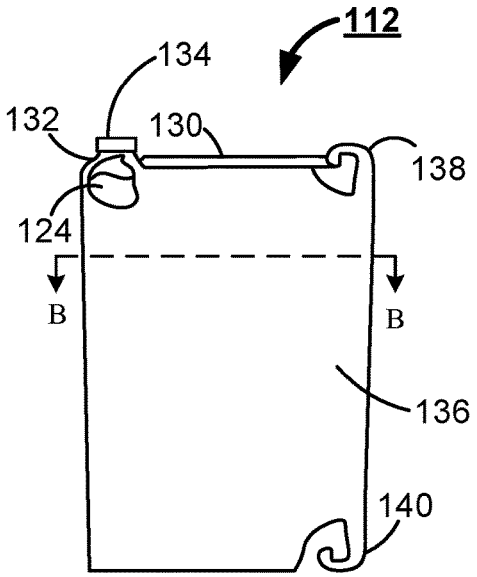
FIG. 3 shows a view in elevation of a flat side of an exemplary embodiment of a shape holding inner container.
Figure 9:
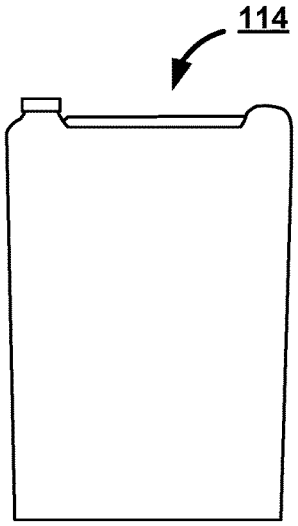
FIG. 9 provides a view in elevation of a side of an alternate exemplary embodiment of a shape holding inner container, the alternate exemplary embodiment includes a pair of volumes sharing a common separation wall that isolates a first viscous material contained in a first of the pair of volumes from a second viscous material contained in the second of the pair of volumes.
Figure 10:
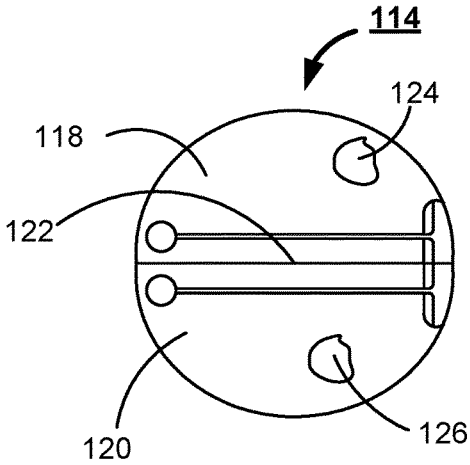
FIG. 10 displays a top plan view of the alternate exemplary embodiment of the shape holding inner container of FIG. 9.
Figure 13:
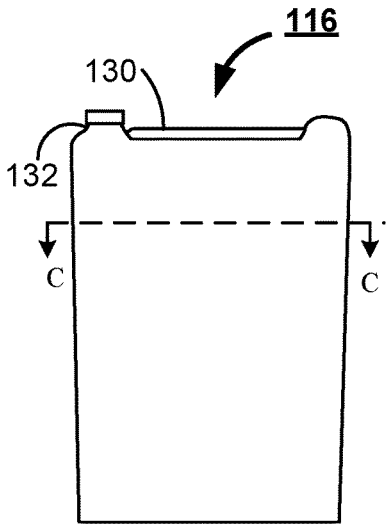
FIG. 13 provides a view in elevation of a side of an alternative exemplary embodiment of a shape holding inner container.

FIG. 3 shows an exemplary embodiment of a shape holding inner container 112, while FIG. 9 shows an alternate exemplary embodiment of a shape holding inner container 114, and FIG. 13 shows an alternative exemplary embodiment of a shape holding inner container 116. Preferably, (with the exception of the alternate embodiment shape holding inner container 114, which includes a pair of substantially equal volumetric cavities (118, 120), that share a common separation wall 122, that isolates a first viscous material 124, from a second viscous material 126, as shown by FIG. 10) the shape holding inner containers are intended to be used in pairs, and preferably, the first viscous material 124 is contained by the first of the pair while the second viscous material 126 is contained by the second of the pair. Additionally, in a preferred embodiment, the first viscous material 124 and the second viscous material 126 are separate and distinct viscous materials.

Returning to FIG. 1, preferably an open top 103 of the shape holding inner container 100 has an area greater than the area of the hermetically sealed bottom 110. The difference in area between the open top and the sealed bottom of the shape holding outer container 100, promotes ease of entry of the shape holding inner container 112 into the shape holding outer container 100, while the area of the hermetically sealed bottom 110, of the shape holding outer container 100, interacts with the shape holding inner container 112, thereby securing the shape holding inner container 112, within the shape holding outer container 100 for stability of the shape holding inner container 112 during transport of the product.

Figure 8:
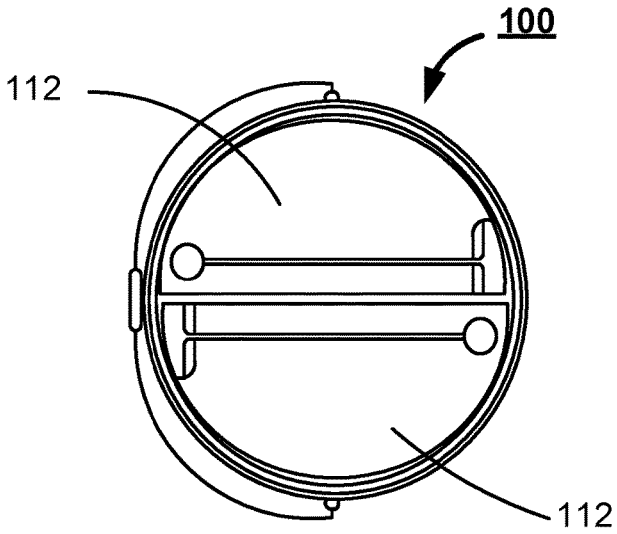
FIG. 8 illustrates a top plan view of a pair of shape holding inner containers of FIG. 3, nested in the shape holding outer container of FIG. 1.
Figure 18:
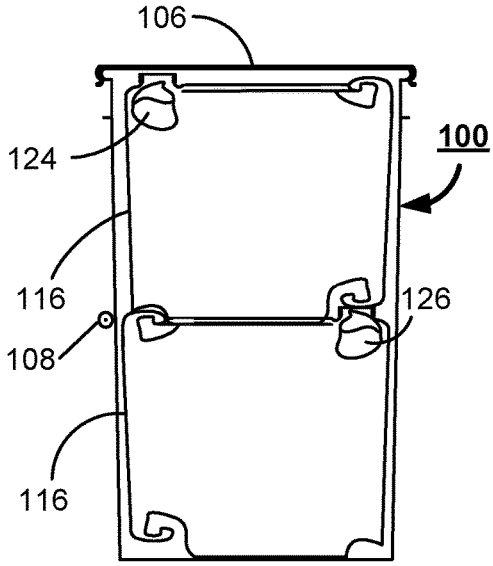
FIG. 18 displays the alternative exemplary embodiment of the shape holding inner container of FIG. 13, nested in the shape holding outer container of FIG. 1.
Figure 20:
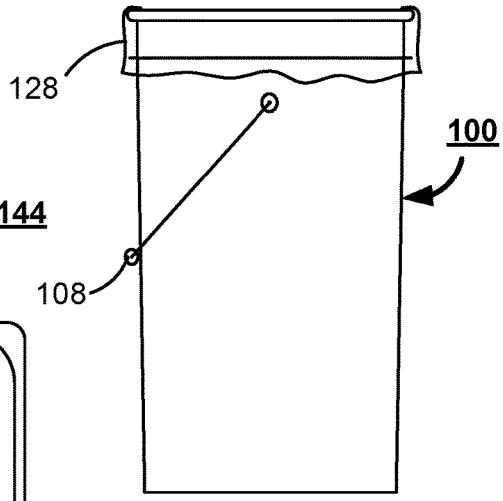
FIG. 20 illustrates a view in elevation of the shape holding outer container of FIG. 1, with a liner formed of a flexible polymer disposed therein.

FIG. 8 shows a pair of the exemplary embodiment of a shape holding inner container 112 nested within the shape holding outer container 100, while FIG. 18 shows a pair of the alternative exemplary embodiment of a shape holding inner container 116 nested within the shape holding outer container 100. In a preferred embodiment, whether a single inner container (114), or a pair of inner containers (112 or 116), the first and second viscous materials (124, 126) are dispensed into the internal volume 102 of the shape holding outer container 100, and mixed together for use. In a further preferred embodiment, a liner 128 (see FIG. 20), formed of a flexible polymer is disposed within the internal volume 102 of the shape holding outer container 100, prior to the mixing together of the first and second viscous materials (124, 126). The first and second viscous materials (124, 126) are then dispensed into the lined shape holding outer container 100 for mixing. In a use environment, such as setting utility poles, following the mixing of the first and second viscous materials (124, 126), the mixture is dispensed into the pole hole, the liner is removed from the shape holding outer container 100 and stuffed down the hole adjacent the pole, and the mixture undergoes a chemical reaction and expands to fill the pole hole while encapsulating the liner 128.

Figure 4:
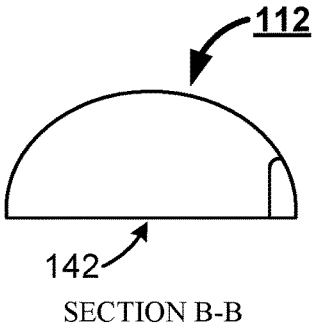
FIG. 4 illustrates a cross section view of the shape holding inner container of FIG. 3.

Returning to FIG. 3, in a preferred embodiment shape holding inner container 112 includes a pressure equalization conduit 130, a spout portion 132, the spout portion 132 is sealed by a cap 134 to assure the viscous material 124, contained within the internal volume 136, of the shape holding inner container 112, remains intact until its appointed use. Preferably, the pressure equalization conduit 130 provides an air passageway into the internal volume 136, by way of a handhold 138. The pressure equalization conduit 130, promotes an even flow of the shape holding inner container 112 while the viscous material 124 is flowing out of the spout portion 132. Further, the shape holding inner container 112 also provides a second handhold 140 in an alternate embodiment. Preferably, the shape holding inner container is formed into the shape of a capital letter "D", 142, as shown by FIG. 4.

Figure 5:
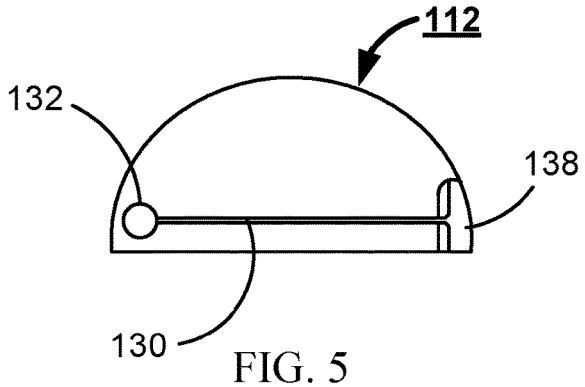
FIG. 5 provides a top plan view of the shape holding inner container of FIG. 3.
Figure 7:
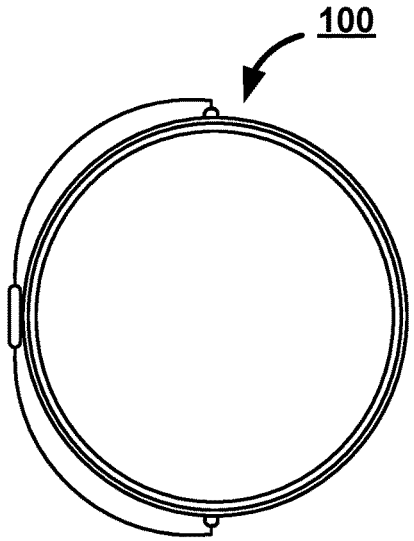
FIG. 7 shows a top plan view of the shape holding outer container of FIG. 1.
Figure 6:
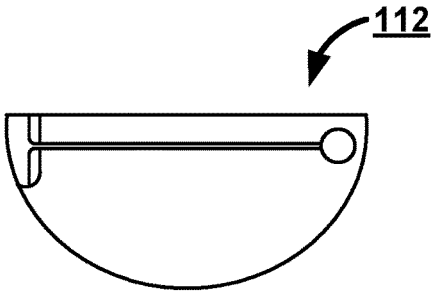
FIG. 6 displays a top plan view of the shape holding inner container of FIG. 5, rotated one hundred and eighty degrees.

In FIG. 5, the top plan view of the shape holding inner container 112 shows that the pressure equalization conduit 130 provides fluidic communication between the spout portion 132, and the handhold 138. FIG. 6 shows the shape holding inner container 112, of FIG. 5 rotated ninety degrees. The "D" shape of the shape holding inner container 112 promotes the ability of having a pair of shape holding inner containers 112, nested within the shape holding outer container 100 (of FIG. 7), as shown by FIG. 8.

Figure 11:
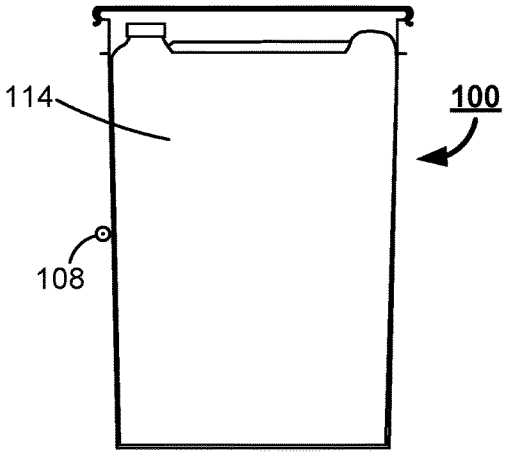
FIG. 11 shows a top plan view of the exemplary embodiment of the shape holding outer container of FIG. 1, without the lid affixed thereon.
Figure 12:
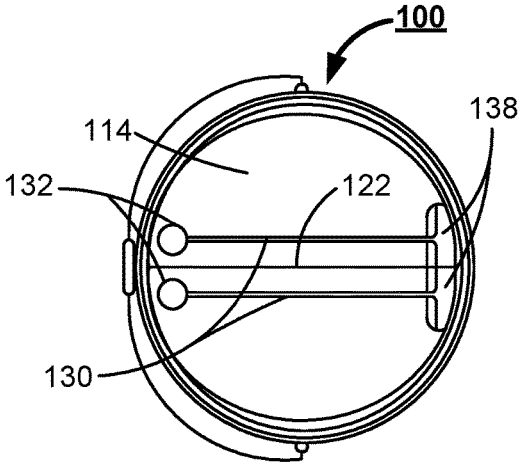
FIG. 12 illustrates the alternate exemplary embodiment of the shape holding inner container of FIG. 9, nested in the shape holding outer container of FIG. 1.

Preferably, the alternative embodiment of the shape holding inner container 114, of FIG. 9, includes a pair of pressure equalization conduits 130, promoting fluidic communication between a pair of spouts 132, and a pair of handholds 138, as shown by FIG. 12. FIG. 11 shows a top plan view of the shape holding outer container 100, without the lid 106 of FIG. 1, is sized to accommodate the alternative embodiment of the shape holding inner container 114, of FIG. 10, nested within the confines of the shape holding outer container 100, as shown by FIG. 12.

Figure 14:
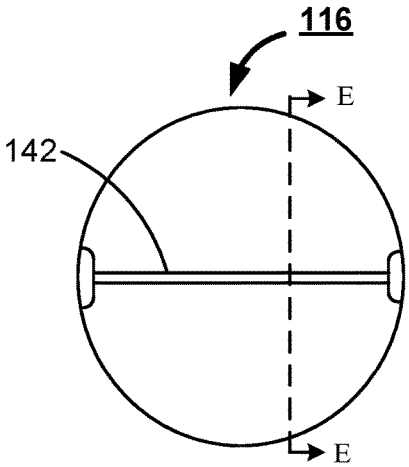
FIG. 14 displays a plan view in cross section of the alternative exemplary embodiment of a shape holding inner container of FIG. 13.
Figure 15:
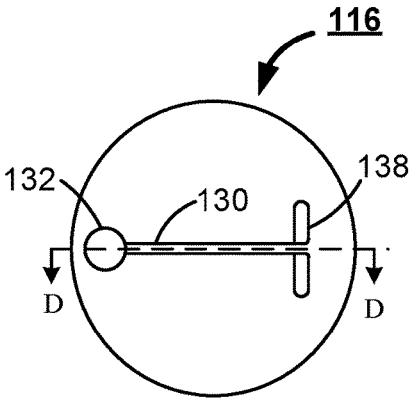
FIG. 15 shows a top plan view of the alternative exemplary embodiment of the shape holding inner container of FIG. 13.
Figure 16:
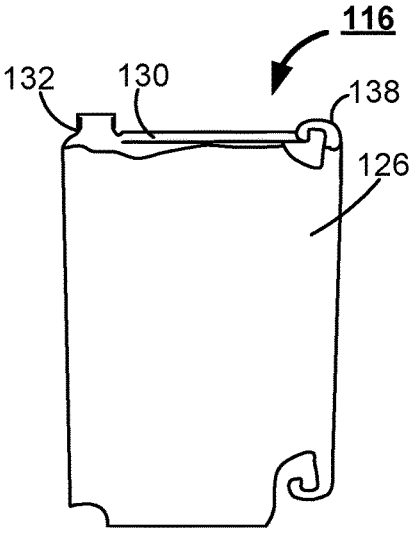
FIG. 16 illustrates a cross section view in elevation of the alternative exemplary embodiment of the shape holding inner container of FIG. 15.
Figure 17:
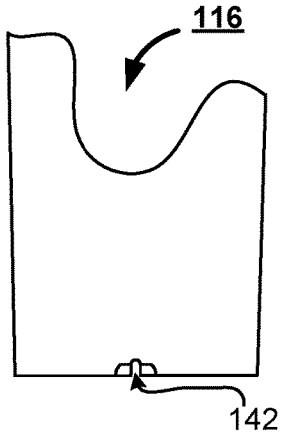
FIG. 17 provides a partial cut away, cross section view in elevation of a side of the alternative exemplary embodiment of the shape holding inner container of FIG. 14.
Figure 19:
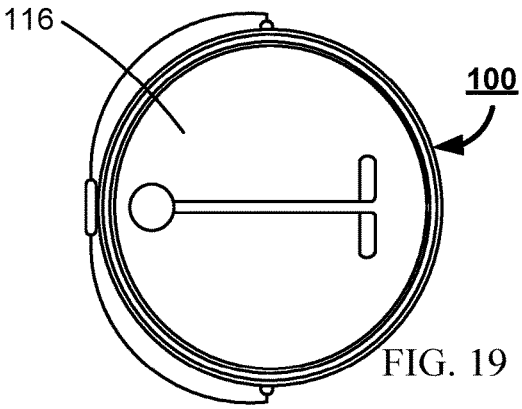
FIG. 19 shows a top plan view of the alternative exemplary embodiment of the shape holding inner container of FIG. 13, nested in the shape holding outer container of FIG. 1.

FIG. 13 shows an alternative embodiment of the shape holding inner container 116, which is preferably configured to be stackable within the shape holding outer container 100, as shown by FIG. 18. In a preferred stackable configuration, the alternative embodiment of the shape holding inner container 116 provides a pressure equalization conduit channel 142, as shown by FIGS. 14 and 17. In the stackable configuration, the pressure equalization conduit 130 (FIG. 15) of a first shape holding inner container 116, nests within the pressure equalization conduit channel 142 of a second shape holding inner container 116, as shown by FIGS. 18 and 19.

Figure 21:
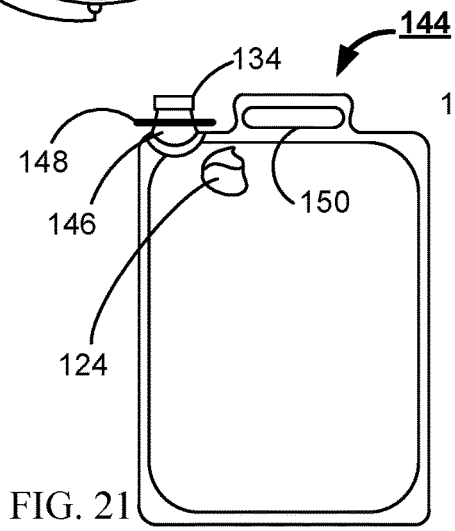
FIG. 21 provides a view in elevation of a non-shape holding inner container, formed from a flexible polymer.

FIG. 21 shows another preferred embodiment of an inner container, which is preferably a non-shape holding inner container 144. In a preferred embodiment, the non-shape holding inner container 144 is configured to accommodate the nesting of a pair of non-shape holding inner containers 144 within the shape holding outer container 100. Preferably, the non-shape holding inner container 144 are aligned within the shape holding outer container 100 in a side by side configuration, but may be alternatively stacked one upon the other.

In a preferred embodiment, the non-shape holding inner container 144, includes at least a spout 146 with an integrated fill land 148. The fill land 148, serves to interface with a fill station fixture (not shown), to promote dispensing of the viscous material (selectively either 126 or 124), into the internal volume of the non-shape holding inner container 144. The non-shape holding inner container 144 further preferably includes an integrated handle 150, to facilitate placement in and removal of, the non-shape holding inner container 144 from the interior of the shape holding outer container 100.

Figure 22:
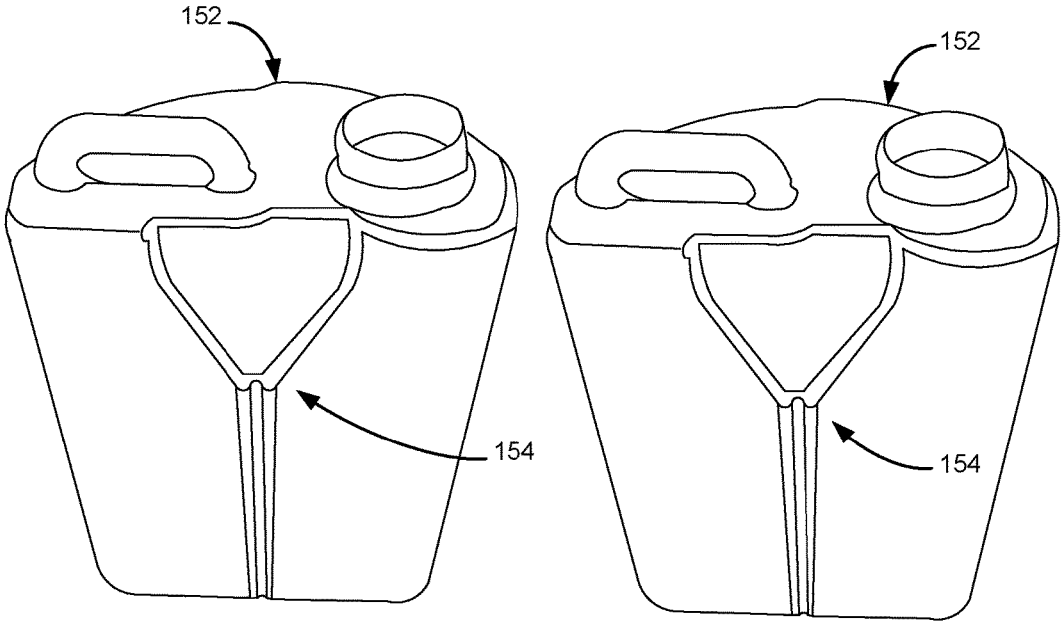
FIG. 22 illustrates a view in elevation of a pair of alternate alternative embodiment shape holding inner containers, each providing a fluid agitation recess.

FIG. 22, illustrates a view in elevation of a pair of alternate alternative embodiment shape holding inner containers 152. Each of the alternate alternative embodiment shape holding inner containers 152 provides a fluid agitation recess 154.

Figure 24:
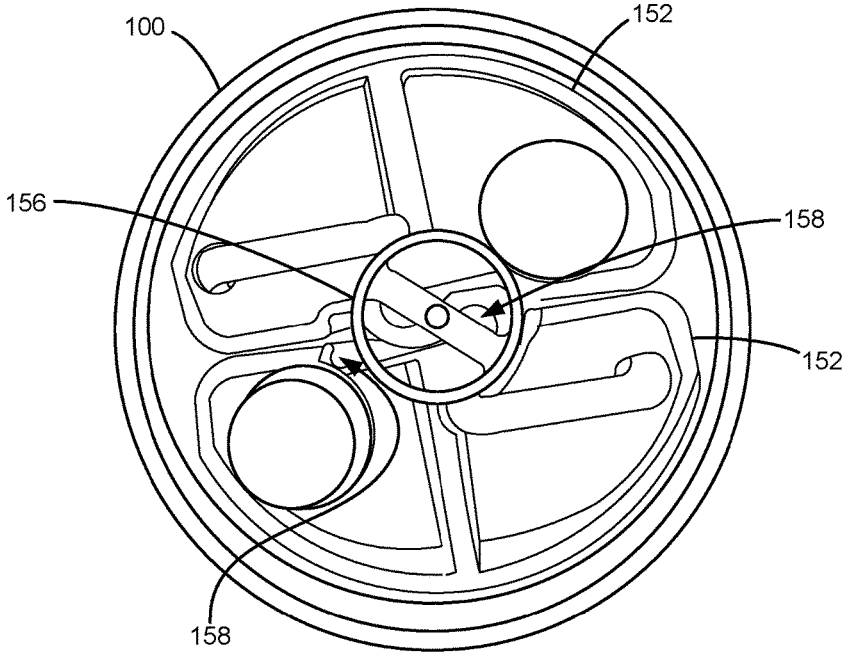
FIG. 24 shows a top plan view of a kit that includes the shape holding outer container of FIG. 1, which confines the pair of alternate alternative embodiment shape holding inner containers of FIG. 22, and the fluid agitating device of FIG. 23 nested within a fluid agitation pocket, the fluid agitation pocket is formed by the pair of fluid agitation recesses, when the pair of fluid agitation recesses are directly adjacent one another as a result of the pair of alternate alternative embodiment shape holding inner containers being confined within the shape holding outer container of FIG. 1.
Figure 23:
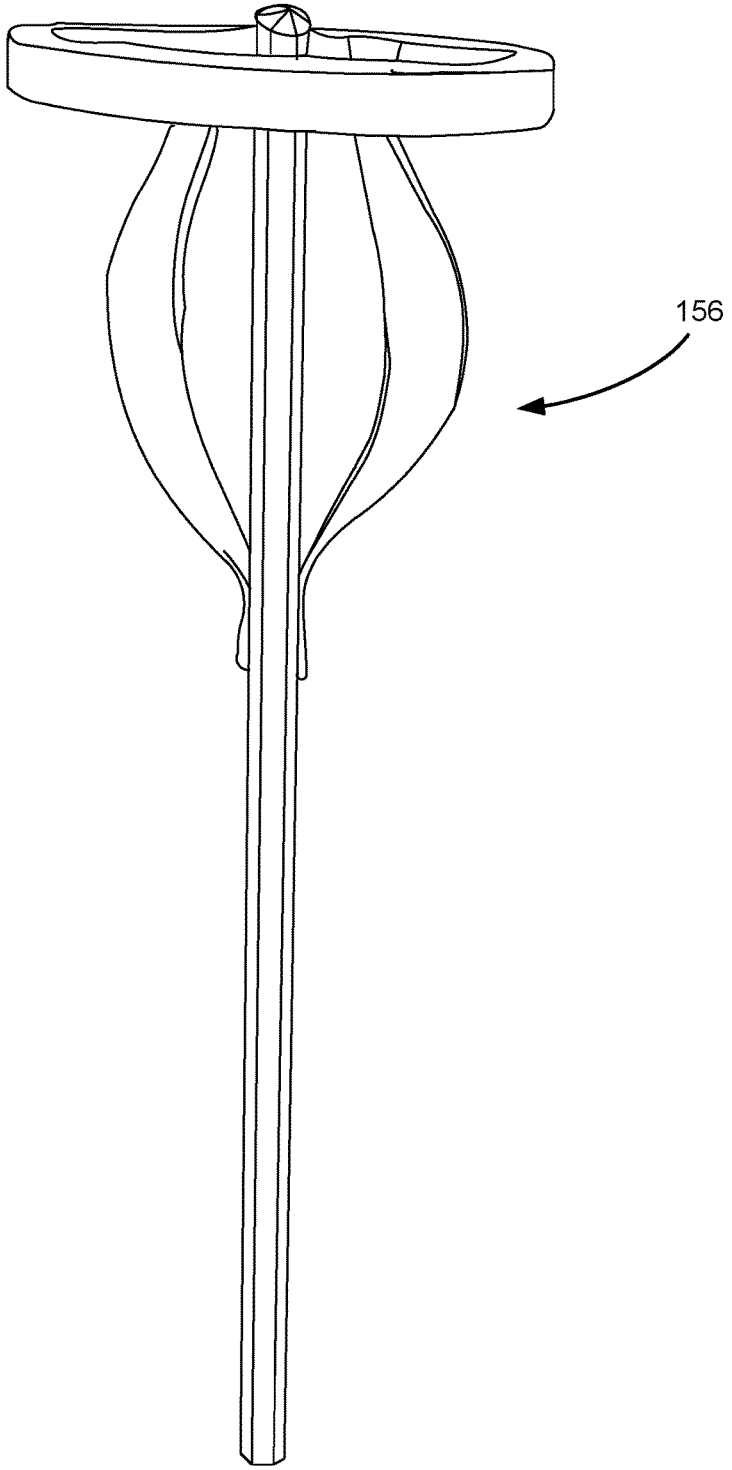
FIG. 23 provides a view in elevation of a fluid agitation device, which is accommodated by the pair of recesses of the pair of alternate alternative embodiment shape holding inner containers.

FIG. 23 provides a view in elevation of a fluid agitation device 156, which is accommodated by the pair of recesses 154, of the pair of alternate alternative embodiment shape holding inner containers 152, when the pair of alternate alternative embodiment shape holding inner containers 152, are positioned adjacent each other to form a fluid agitation pocket 158, of FIG. 24.

FIG. 24 shows a top plan view of a kit that includes the shape holding outer container 100, of FIG. 1, which confines the pair of alternate alternative embodiment shape holding inner containers 152, and the fluid agitating device 156, nested within the fluid agitation pocket 158. The fluid agitation pocket 158, is formed by the pair of fluid agitation recesses 154, when the pair of fluid agitation recesses 154, are directly adjacent one another, as a result of the pair of alternate alternative embodiment shape holding inner containers 152, are being confined within the shape holding outer container 100.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present claimed invention to the full extent indicated by the broad general meaning of the terms in which the appended claims are expressed. For example, the particular elements may vary depending on the particular application without departing from the spirit and scope of the present claimed invention.

It will be clear that the present invention is well adapted to attain the ends and advantages mentioned as well as those inherent therein. While presently preferred embodiments have been described for purposes of this disclosure, numerous changes may be made which will readily suggest themselves to those skilled in the art and which are encompassed by the appended claims.

What is claimed is:

1. A packaging kit comprising:

a shape holding outer container having an internal volume and an external surface, wherein the internal volume is not less than two liters, in which the shape holding outer container includes a hermetically sealed bottom and an open top, the open top has an opening with an area greater than the area of the hermetically sealed bottom;

a pair of, but not more than two, shape holding inner containers disposed within the outer container, in which the shape holding inner containers each provide an agitation device recess, each shape holding inner container has an internal wall and an external wall, and in which each agitation device recess is an open channel recess, said each open channel recess is formed into and along an entirety of a length of each external wall of each shape holding inner container; and a fluid agitating device nested within a fluid agitation device pocket, the fluid agitation device pocket formed by the pair of fluid agitation device recesses, when the pair of fluid agitation device recesses are directly adjacent one another by way of the pair of the shape holding inner containers being confined within the shape holding outer container, and in which each shape holding inner container remains detached from the outer container at all times, wherein the open top of the shape holding outer container having an area greater than the area of the hermetically sealed bottom promotes ease of entry of each of the shape holding inner containers into the shape holding outer container, while the area of the hermetically sealed bottom of the shape holding outer container interacts with each of the shape holding inner containers, thereby securing the pair of shape holding inner containers within the shape holding outer container.

2. The kit of claim 1, in which a first shape holding inner container of the pair of shape holding inner containers, confines a first viscous material, and wherein a second shape holding inner container of the pair of shape holding inner containers confines a second viscous material, in which said first and said second viscous materials are separate and distinct viscous materials.

3. The kit of claim 2, in which the shape holding outer container provides a lip portion encircling the open top, and further comprises a lid interacting with the lip, the lid seals the internal volume, and the lid reseals the internal volume upon removal and reengagement of the lid with the lip.

4. The kit of claim 3, in which the shape holding outer container is an elongated cylinder having a circular cross section.

5. The kit of claim 4, in which each the first and second shape holding inner containers are formed to present a common geometric form.

6. The kit of claim 5, in which the first and second shape holding inner containers each includes a hermetically sealed bottom and an open top, the open tops have an opening with an area less than the area of the hermetically sealed bottom.

7. The kit of claim 6, in which each shape holding inner container provides an interior volume and a spout portion encircling the open top, and further comprises a cap interacting with the spout portion, the cap seals the interior volume, and the cap reseals the internal volume upon removal and reengagement of the cap with the spout portion.

8. The kit of claim 7, further comprising a liner in contact adjacency with an internal surface of the shape holding outer container and an external surface of each the first and second shape holding inner containers.

9. The kit of claim 8, in which the liner is formed from a flexible polymer.

10. The kit of claim 9, in which the shape holding outer container is formed from a material selected from a group consisting of (polymers, composites, and metallic), and in which each shape holding inner container is formed from a material selected from a group consisting of (polymers, composites, and metallic).

11. The kit of claim 5, in which a cross section of the common geometric shape takes the form of a capital letter D.

12. The kit of claim 1, in which each shape holding inner container comprising:

a first interior volume formed by a first hermetically sealed bottom, a first side wall, and a first top providing a first sealable opening, the first interior volume containing a first viscous material;

a second interior volume adjacent the first interior volume, the second interior volume formed by a second hermetically sealed bottom, a second wall, and a second top providing a second sealable opening, the second interior volume containing a second viscous material, wherein the first and second viscous materials are separate and distinct viscous materials; and the fluid agitation device pocket providing vertical and horizontal support for the fluid agitating device.

13. The kit of claim 12, in which the pair of shape holding inner containers further comprising:

a first container of the pair of shape holding inner containers including at least a first spout portion encircling a first open top, the first open top distal from the first hermetically sealed bottom;

a first cap interacting with the first spout portion, the first cap seals the interior volume, the first cap further reseals the first internal volume upon removal and reengagement of the first cap with the first spout portion;

a second container of the pair of shape holding inner containers includes at least a second spout portion encircling a second open top, the second open top distal from the second hermetically sealed bottom, the second spout portion adjacent the first spout portion; and a second cap interacting with the second spout portion, the second cap seals the interior volume, the second cap further reseals the first internal volume upon removal and reengagement of the first cap with the first spout portion.

14. The kit of claim 13, in which the pair of shape holding inner containers further comprising:

a first handhold disposed adjacent the first spout portion of the first container; and a second handhold disposed adjacent the second spout portion of the second container.

* * * * *